US009434523B2

(12) United States Patent
Gicewicz

(10) Patent No.: US 9,434,523 B2
(45) Date of Patent: Sep. 6, 2016

(54) RECLOSABLE PACKAGE

(71) Applicant: Amcor Flexibles, Kreuzlingen (CH)

(72) Inventor: Jan Gicewicz, Gora Kalwaria (PL)

(73) Assignee: Amcor Flexibles, Kreuzlingen (CH)

( * ) Notice: Subject to any disclaimer, the term of this patent is extended or adjusted under 35 U.S.C. 154(b) by 0 days.

(21) Appl. No.: 14/439,490

(22) PCT Filed: May 24, 2013

(86) PCT No.: PCT/EP2013/060703
§ 371 (c)(1),
(2) Date: Apr. 29, 2015

(87) PCT Pub. No.: WO2014/067673
PCT Pub. Date: May 8, 2014

(65) Prior Publication Data

US 2015/0298880 A1 Oct. 22, 2015

(30) Foreign Application Priority Data

Oct. 30, 2012 (EP) ..... 12190488

(51) Int. Cl.
*B65D 75/58* (2006.01)
*B65D 65/14* (2006.01)
*B65D 75/20* (2006.01)

(52) U.S. Cl.
CPC ..... *B65D 75/58* (2013.01); *B65D 65/14* (2013.01); *B65D 75/20* (2013.01); *B65D 75/5855* (2013.01); *B65D 2575/586* (2013.01)

(58) Field of Classification Search
CPC .... B29C 66/43; B32B 37/0076; B65D 75/58
USPC ..... 206/484, 410; 156/247, 290, 291, 714
See application file for complete search history.

(56) References Cited

U.S. PATENT DOCUMENTS 3,595,468 A * 7/1971 Repko ..... B65D 75/68 206/0.84
4,252,238 A * 2/1981 Spiegelberg ..... A61L 9/12 206/260
4,428,477 A * 1/1984 Cristofolo ..... B65D 75/5827 206/210
5,885,673 A * 3/1999 Light ..... B32B 27/08 206/455

FOREIGN PATENT DOCUMENTS

DE 2658631 A1 6/1978
EP 1939106 B1 3/2009
GB 2337243 A 11/1999

* cited by examiner

*Primary Examiner* — King M Chu
(74) *Attorney, Agent, or Firm* — Reinhart Boerner Van Deuren P.C.

(57) ABSTRACT

The present invention is related to a reclosable flow pack comprising one or more fin seal(s) (30) and one or more cross-seal(s) (31), said flow pack comprising a cold-seal adhesive pattern (11, 301, 302, 401, 402) forming a seal between a first (3) and a second (4) sealing portion, the cold-seal adhesive pattern (301, 401) of the first portion being only partly in register with the cold-seal adhesive pattern (302, 402) of the second portion, the bonding force of the cold-seal adhesive to the first (3) and the second (4) sealing portions being lower than the bonding force within the cold-seal adhesive on the portions in register (7, 100, 101), so that the cold-seal adhesive on the portions of the cold-seal adhesive patterns in register is separated from the first or from the second sealing portion when the seal is opened.

13 Claims, 4 Drawing Sheets

RECLOSABLE PACKAGE

FIELD OF THE INVENTION

The present invention is related to a reclosable package, in particular to a reclosable package comprising a specific cold-seal pattern and specific cold-seal features.

STATE OF THE ART

Due to consumer requests, packaging in general, and in particular confectionary packaging, progressively evolves to reclosable packaging. Sophisticated reclosability means, in particular for cold seal applications, are therefore developed by the flexible-film packaging industry.

EP 1 939 106 B1 (Kraft) discloses a package comprising a cold seal wherein the adhesive in the sealed packaging has higher adhesion force to the packaging film than cohesive force within the adhesive. This means that, after the package is opened, the cold seal stays on both opened sides of the packaging and may be closed again, progressively losing its adhesion force after the first opening, upon each subsequent opening.

GB-A-2 337 243 discloses a pack having a first upper region with a pattern, and an adjacent second upper region, with a pattern that is in register with any pattern of the first upper region, the pack also having an openable peelable seal, wherein the first and second upper regions are formed from the same sheet of patterned material.

Polyolefin and particularly BOPP polymer films are widely used for reclosable packagings. Cold-seal adhesives generally have a poor adhesion to polymer films. These films are therefore usually surface-treated (atmospheric plasma, flame, . . . ) but the change of surface properties is limited in time. Even when the film is surface-treated, the adhesion of the freshly-treated film on cold-seal adhesive is lower than the cold-seal-to-cold-seal adhesion, so that, when the package is opened at the end of the shelf life, the entire adhesive layer is removed from one side of the film, which renders the reclosing difficult, as the reclosing adhesion of the cold-seal surface to aged-treated film surface is poor.

Furthermore, the adhesion of peelable cold-seal adhesive on itself has a tendency to increase with time, which makes it difficult to ensure that the failure location remains between the cold-seal adhesive. This represents a particular quality issue, as a product that is conform to the opening specification to start with, may lose its specification during its shelf life, causing the failure at the interface between the cold-seal adhesive and the substrate surface. Even worse, in the case of weak substrates, such as cavitated films, cohesive failure may occur in the substrate itself.

SUMMARY OF THE INVENTION

The present invention discloses a reclosable flow pack comprising one or more fin seal(s) and one or more cross-seal(s), said flow pack comprising a cold-seal adhesive pattern forming a seal between a first and a second sealing portion, the cold-seal adhesive pattern of the first portion being only partly in register with the cold-seal adhesive pattern of the second portion, the bonding force of the cold-seal adhesive to the first and the second sealing portions being lower than the bonding force within the cold-seal adhesive on the portions in register, so that the cold-seal adhesive on the portions of the cold-seal adhesive patterns in register is separated from the first or from the second sealing portion when the seal is opened.

Preferred embodiments of the present invention disclose at least one, or an appropriate combination of the following features:

- the area in register represents 80% or less, preferably 70% or less, more preferably 50% or less;
- the one or more fin seal(s) comprise(s) coldseal-free flaps;
- the flow pack comprises a continuous seal line around for ensuring air tightness;
- the flow pack comprises corona-treated, oriented polyolefin films;
- the cold seal comprises a natural latex or synthetic latex;
- the cold seal comprises at least 50% of said natural or synthetic latex, preferably at least 70% of said natural or synthetic latex;
- the cold seal contains at least one acrylic polymer or copolymer;
- the cold seal contains at least one styrene acrylic polymer or copolymer, preferably two different types thereof;
- the adhesion strength of the cold seal is comprised between 2 and 8 N/25 mm.

SHORT DESCRIPTION OF THE DRAWINGS

Figure 4A:
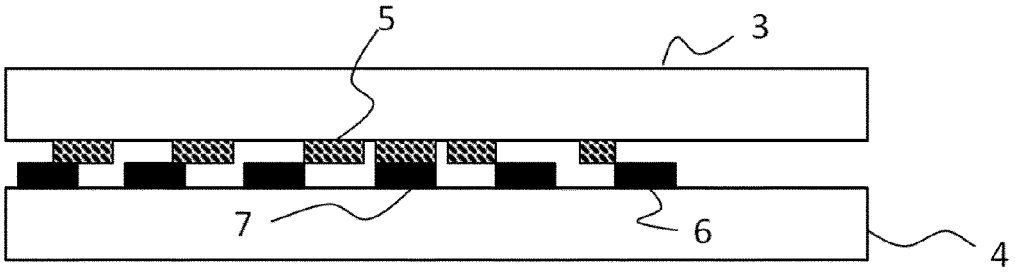

FIG. 4*a* represents a cross-section of a reclosable seal of a package according to the invention before opening.

Figure 4B:
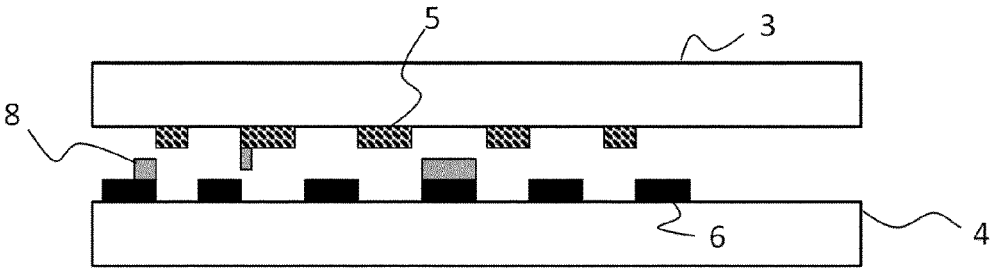

FIG. 4*b* represents a cross-section of a reclosable seal of a package according to the invention after a first opening.

Figure 4C:
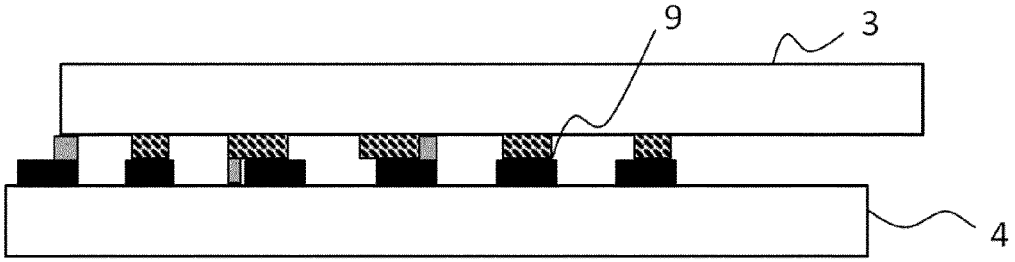

FIG. 4*c* represents a cross-section of a reclosable seal of a package according to the invention after a first reclosing.

Figure 5:
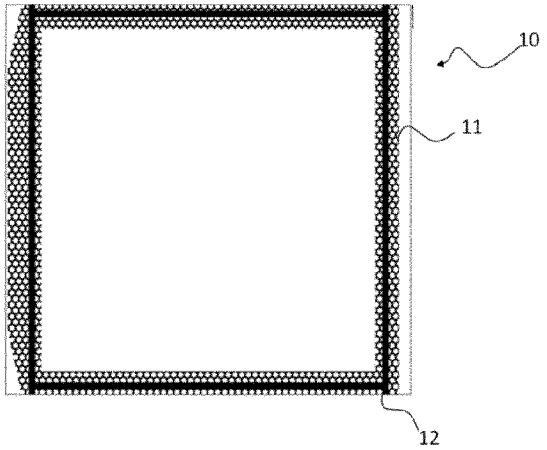

FIG. 5 represents a film forming the package of the invention before the forming process, showing the patterned adhesive layer.

Figure 6:
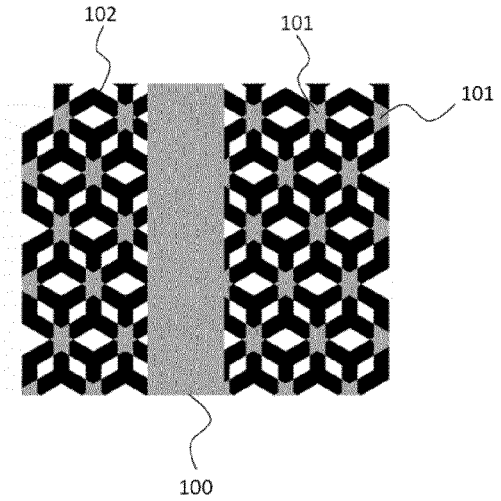

FIG. 6 represents an example of initial seal of a package according to the invention.

Figure 7:
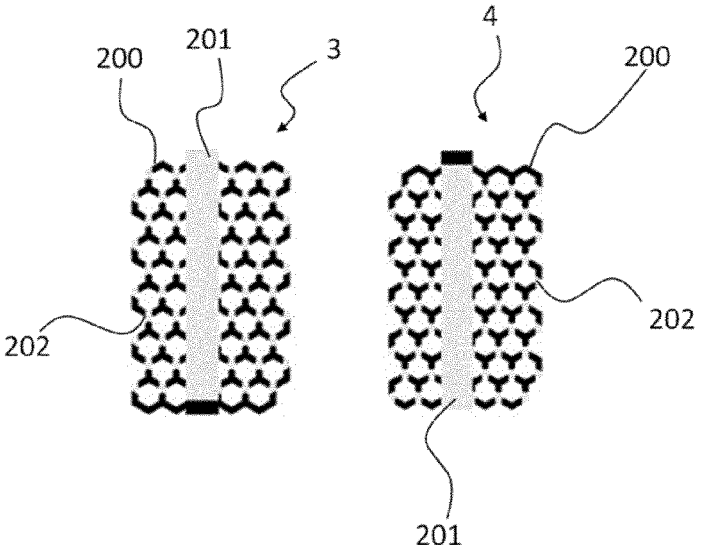

FIG. 7 represents the pattern of residual adhesive after a first opening of the seal of FIG. 6.

Figure 8:
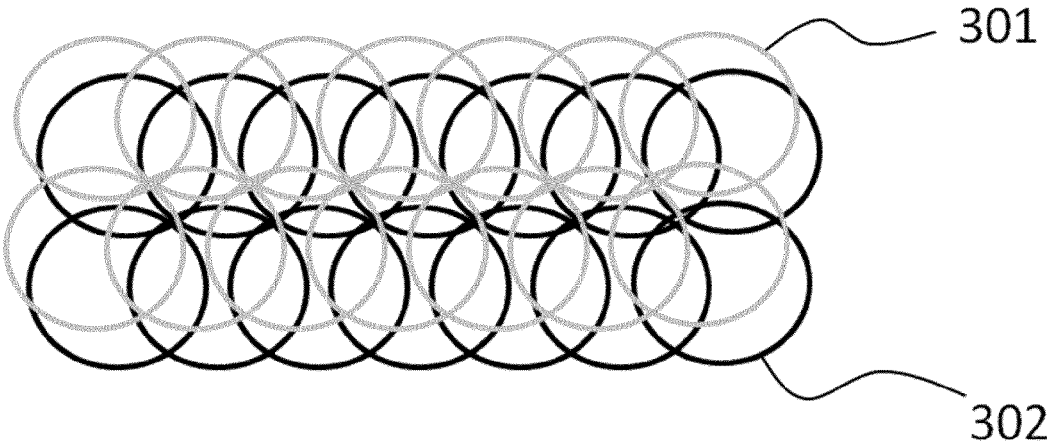

FIG. 8 represents an example of pattern of cold-seal adhesive.

Figure 9:
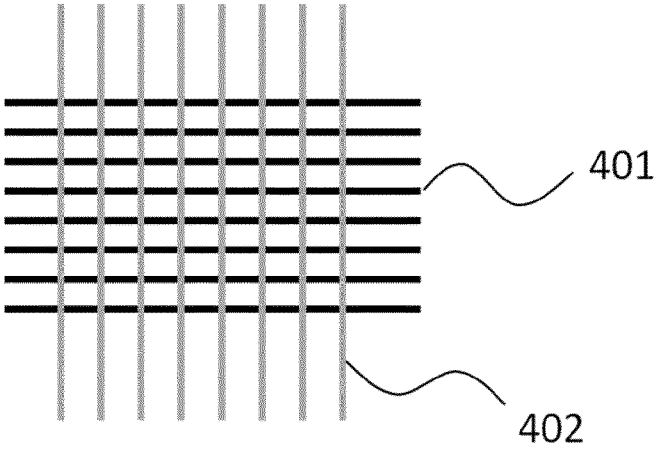

FIG. 9 represents an example of pattern of cold-seal adhesive.

LIST OF REFERENCE SYMBOLS

1. closed package
2. opened package
3. first sealing portion
4. second sealing portion
5. cold-seal adhesive of the first sealing portion
6. cold-seal adhesive of the second sealing portion
7. cold-seal adhesive in register
8. residual cold-seal adhesive of a sealing portion left on the other sealing portion after a first opening
9. new seal formed after reclosing
10. unfolded sheet of the package of the invention
11. partial cold-seal pattern
12. continuous cold-seal pattern
30. fin seal
31. cross-seal
100. continuous seal area
101. in register seal area
102. out-of-register seal area

200. residual fresh cold-seal adhesive
201. opened continuous cold-seal adhesive
202. opened discontinuous cold-seal adhesive
301. cold-seal adhesive of the first sealing portion
302. cold-seal adhesive of the second sealing portion
401. cold-seal adhesive of the first sealing portion
402. cold-seal adhesive of the second sealing portion

DETAILED DESCRIPTION OF THE INVENTION

The present invention is related to a reclosable flow pack comprising a patterned cold-seal adhesive layer. Such kind of flow pack is usually produced by folding a polymeric sheet 10 around the product to be packaged. As seen in FIG. 5, the pattern of the cold-seal adhesive is applied in the periphery of the unfolded polymeric sheet. A pattern should be understood as a repeated decorative design.

The problem when using non-patterned reclosable cold seal is that on some particular polymers, such as polyolefins and other apolar polymers, the cold-seal adhesive adheres more on itself than on the film substrate. This means that when the seal is opened, the adhesive layer randomly remains on one side or the other, leaving one side of the opened seal with the uncovered substrate. In that case, the adhesion obtained when reclosing the seal is poor. This phenomenon is considered as a major quality fault in prior-art reclosable cold seal. Such quality faults are particularly difficult to control on BOPP-based substrates. This problem is particularly observed with surface-treated polyolefins, wherein the adhesion between the freshly-treated substrate and the cold-seal adhesive is high, but the effect of the surface treatment on this adhesion is strongly reduced with ageing time. Surface treatments include for example corona, plasma or chemical treatments, commonly used to enhance adhesion.

Figure 1:
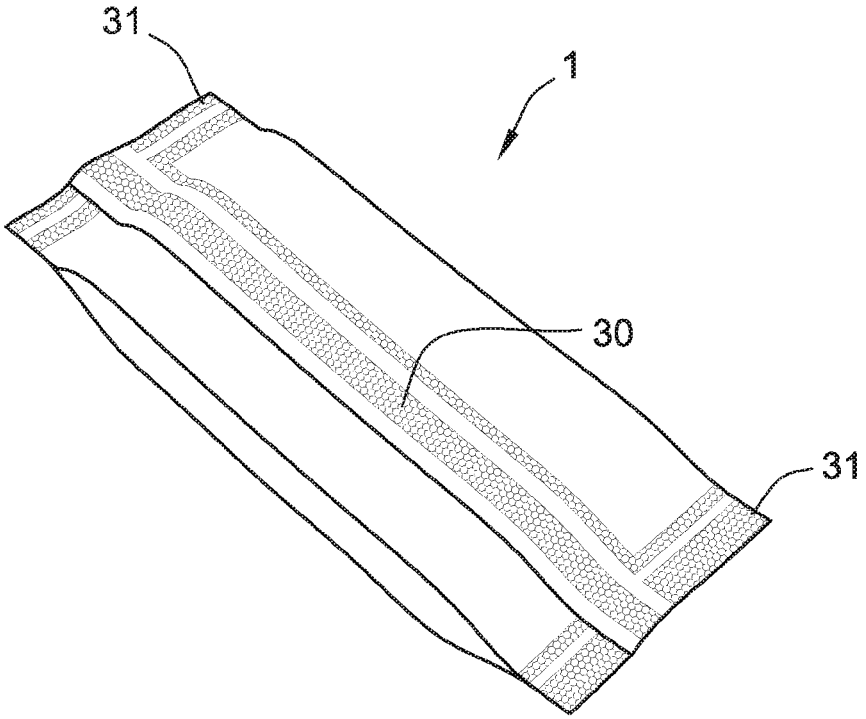
FIG. 1 represents an example of package according to the invention.
Figure 2:
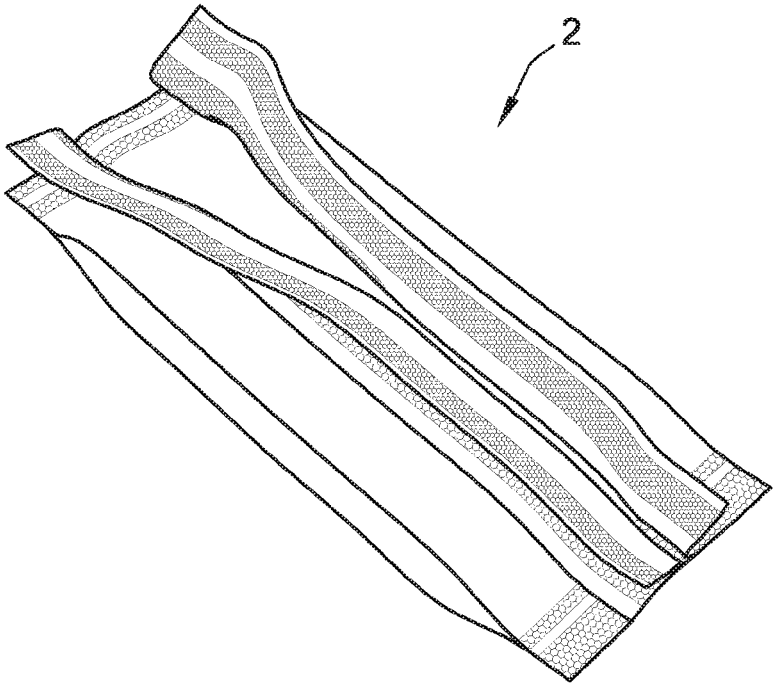
FIG. 2 represents an example of package according to the invention during opening.
Figure 3:
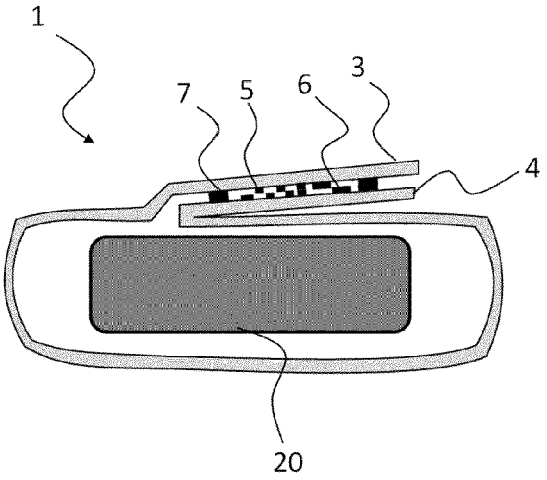
FIG. 3 represents a cross-section of a package according to the invention.

The idea behind the present invention is to maintain a portion of the adhesive unused upon the first sealing process. This is represented in cross-section in FIGS. 3 and 4*a*, wherein a package is closed by sealing a first sealing portion 3 onto a second sealing portion 4, by means of a patterned cold-seal adhesive, only a part of the cold-seal adhesive on the first sealing portion being in register 7 with the cold-seal adhesive on the second sealing portion. The other cold-seal adhesive, which is not in register 5, 6, remaining as deposited on the film.

FIGS. 4*a*, 4*b* and 4*c* represent the opening and reclosing process of the disclosed seal. In FIG. 4*a*, the different areas with adhesive portions that are in register 7 and adhesive portions that are not in register 5,6 can be seen.

Upon opening, as represented in FIG. 4*b*, the adhesive initially in register 7 delaminates from one of the sealing portion 3, 4, leaving fragments 8 randomly distributed on those portions. The left fragments 8 exhibit only poor adhesion when they come in direct contact with the film substrate.

As represented in FIG. 4*c*, when reclosing, a slight shift is introduced between the first sealing portion 3 and the second sealing portion 4, so that fresh cold-seal adhesive becomes in register 9. The new seal can be partly induced by fresh areas 5, 6 which were not previously in register, and partly induced by delaminated area particles 8 adhering on fresh areas 5, 6 or on other delaminated area 8. Therefore, even if the entire initial seal area has delaminated, the package remains reclosable thanks to the remaining (unused) cold seal.

By delamination, it is meant in the present invention any adhesive failure (separation) at an interface between two materials.

FIG. 5 represents an example of adhesive pattern applied on a film substrate 10 before forming the package. In this example, there is a discontinuous adhesive pattern 11 and a continuous adhesive pattern 12, this last pattern being preferably applied to ensure air-tightness during the shelf-life of the packaged product 20. The discontinuous pattern 11 ensures that a part of the adhesive can be out of register 102 upon the first sealing while maintaining air-tightness. The presence of a continuous, in-register area also has the advantage of providing a stronger opening force on the first opening than on subsequent openings.

FIG. 6 represents a top view of the initial seal obtained when folding the film of FIG. 5. The grey areas 100, 101 are portions where the cold-seal adhesives of the pattern of a first sealing portion 3 are in register with the cold-seal adhesives of the pattern of a second sealing portion 4. Those areas are producing the initial seal which should preferably be airtight. Therefore, the initial, in-register pattern preferably comprises a continuous area 100, originating from continuous lines 12 in the adhesive pattern on the forming film 10 (FIG. 5). The black area 102 in FIG. 6 represents cold-seal adhesive on a sealing portion 3, 4 that is not in register with the cold-seal adhesive of the other seal portion 3, 4. After opening, a partial pattern with fresh (unused) cold-seal adhesive 200 remains on both sides of the sealing portions 3, 4, as represented in FIG. 7. On this figure, the previously sealed area 201, 202, where the cold-seal adhesive has randomly delaminated from the film substrate, can also be seen.

Other cold-seal adhesive patterns can be used in the present invention, as represented in FIGS. 8 and 9. In FIG. 8, the adhesive patterns on the first sealing portion 301 and the adhesive patterns on the second sealing portion 302 are circles, with in-register areas at the crossing between the circles. In FIG. 9, the adhesive patterns on the first sealing portion 401 are horizontal lines crossing the adhesive patterns on the second sealing portion 402, which are vertical lines. Combinations with lines and circles or other shapes can also be used.

In order to ensure an easy reclosability, the ratio in the initial seal between out-of-register and in-register adhesives is preferably at least 20% on each sealing portion.

Typical film structure to be used in the invention are monofilms and multilayers laminates with a patterned cold seal printed in the area to be sealed. The patterned cold seal can for example be obtained by direct gravure-printing technology. The dry application weight preferably ranges from 3 to 5 g/m$^2$.

Examples of multilayer structure for making the reclosable package of the invention are:

release BOPP//BOPP/patterned coldseal, where the second BOPP may be clear transparent, white, white voided;
release BOPP//PET/patterned cold seal;
release BOPP/metallized BOPP/patterned cold seal, where the metallized BOPP can be clear-metallized or metallized white (voided);
release BOPP//paper/patterned cold seal;
release varnish/paper/BOPP (or PET)/patterned cold seal;
release varnish/BOPP/cold seal, where BOPP may be clear transparent, white, white voided, metallized;
release varnish/paper/patterned cold seal;
release varnish/PET/patterned cold seal;

Preferably, the cold-seal composition suitable for the present invention can be described as "soft" cold seal with high rubber content as opposed to "hard" cold seal, usually used for reclosable applications.

Suitable, natural rubber cold seal for untreated and treated coextruded materials comprises more than 50%, preferably more than 70%, natural latex but less than 90% natural latex in the formulation composition and comprises one or more of the following components:

acrylic polymer or copolymers, styrene acrylic polymer or copolymer where the monomers are mainly but not exclusively butyl acrylate, methyl methacrylate and ethyl hexyl acrylate;

styrene copolymer; and, vinyl acetate ethylene copolymer;

the total synthetic polymer proportion of the cold-seal formulation being comprised between 10 and 50% of the final composition.

Suitable synthetic cold-seal composition comprises more than 50%, but less than 90%, synthetic latex elastomer based for example on styrene butadiene and between 10 and 50% of a non-elastomer component comprising one or more of the following: acrylic polymer or copolymers, styrene acrylic polymer or copolymer where the monomers are potentially but not exclusively butyl acrylate, methyl methacrylate and ethyl hexyl acrylate and styrene.

The delamination behaviour of the cold seal can be either controlled by the cold-seal composition itself or by the surface status of the film: tiny changes in the surface treatment can have high impact on the adhesion of the cold seal on the film.

The formulation of such cold-seal material will be selected so that the adhesion of the cold seal on itself (internal adhesion) is higher than the adhesion of the cold seal on the film substrate, and will therefore not give cohesive split as would give cold seal specifically developed for prior-art reclosable application. Such cold-seal compositions are for example commercialised by Henkel under the trade name Coldseal Primaseal™ 22-861 and Coldseal Liofol™ Cs 7301.

The invention claimed is:

1. A reclosable flow pack comprising one or more fin seal(s) (30) and one or more cross-seal(s) (31), said flow pack comprising a cold-seal adhesive pattern (11, 301, 302, 401, 402) forming a seal between a first (3) and a second (4) sealing portion, the cold-seal adhesive pattern (301, 401) of the first portion (1) being only partly in register with the cold-seal adhesive pattern (302, 402) of the second portion (2), the bonding force of the cold-seal adhesive to the first (3) and the second (4) sealing portions being lower than the bonding force within the cold-seal adhesive on the portions in register (7, 100, 101), so that the cold-seal adhesive on the portions of the cold-seal adhesive patterns in register is separated from the first or from the second sealing portion when the seal is opened.

2. The reclosable package according to claim 1, characterized in that the area in register represents 80% or less.

3. The reclosable package according to claim 1, characterized in that the one or more fin seal(s) comprise(s) coldseal-free flaps.

4. The reclosable package according to claim 1, characterized in that said flow pack comprises a continuous seal line (12) around for ensuring air tightness.

5. The reclosable package according to claim 1, characterized in that said flow pack comprises corona-treated, oriented polyolefin films.

6. The reclosable package according to claim 1, characterized in that the cold seal comprises a natural latex or synthetic latex.

7. The reclosable package according to claim characterized in that the cold seal comprises at least 50% of said natural or synthetic latex.

8. The reclosable package according to claim 1, characterized in that the cold seal contains at least one acrylic polymer or copolymer.

9. The reclosable package according to claim 1, characterized in that the cold seal contains at least one styrene acrylic polymer or copolymer, preferably two different types thereof.

10. The reclosable package according to claim 1, characterized in that the adhesion strength of the cold seal is comprised between 2 and 8N/25 mm.

11. The reclosable package according to claim 1, characterized in that the area in register represents 70% or less.

12. The reclosable package according to claim 1, characterized in that the area in register represents 50% or less.

13. The reclosable package according to claim 6, characterized in that the cold seal comprises at least 70% of said natural or synthetic latex.

* * * * *